United States Patent [19]

Ikeda et al.

[11] 4,157,206

[45] Jun. 5, 1979

[54] APPARATUS FOR MANUFACTURING ELECTRIC LAMPS

[75] Inventors: Takeshi Ikeda, Kanuma; Kozo Kawashima, Yokohama; Tetsunori Kai, Fuchu, all of Japan

[73] Assignee: Tokyo Shibaura Electric Co., Ltd., Kawasaki, Japan

[21] Appl. No.: 828,592

[22] Filed: Aug. 29, 1977

[30] Foreign Application Priority Data

Aug. 30, 1976 [JP] Japan ..... 51-103446

[51] Int. Cl.[2] ..... H01J 9/48

[52] U.S. Cl. ..... 316/27; 198/341

[58] Field of Search ..... 316/27; 29/25.19, 25.2; 198/341, 468, 482; 209/548

[56] References Cited

U.S. PATENT DOCUMENTS 2,162,209 6/1939 Trutner ..... 316/30

FOREIGN PATENT DOCUMENTS 692754 8/1964 Canada ..... 198/341

*Primary Examiner*—Richard B. Lazarus

*Attorney, Agent, or Firm*—Cushman, Darby & Cushman

[57] ABSTRACT

An apparatus to carry out one or more of the machining, assembling, treatment and inspection processes for manufacturing electric lamps. The apparatus has a plurality of work heads (hereinafter called simply "heads") which are to be moved. While each head is moving from one position to another, a bulb member held by the head undergoes said process. If any one of the bulb members and/or heads undergone the process is found to be a bad one, to such a defective head new bulb members are not supplied thereafter, thereby preventing production of bad bulb members without interrupting the operation of the apparatus.

9 Claims, 5 Drawing Figures

APPARATUS FOR MANUFACTURING ELECTRIC LAMPS

This invention relates to an apparatus for manufacturing electric lamps, which comprises a body having a plurality of heads each to hold at least one bulb member to move said heads along a closed loop, each bulb member undergoing at least one manufacturing process while moving from one position to a predetermined position; a drive mechanism for driving the body; an unloader for successively taking the bulb members from the heads after the manufacturing process; and a loader for successively supplying new bulb members to the heads.

To produce electric lamps such as fluorescent lamps, incandescent lamps and miniature tubes, glass bulb members undergo various processes such as washing, phosphor coating, mount making, sealing, exhausting, basing, aging and inspection. A glass bulb is subjected to all or some of these processes according to the kind of the lamp to be made. More precisely, to make a fluorescent lamp all these processes are applied. To produce an incandescent lamp, all these processes but phosphor coating are carried out. To manufacture a miniature tube, the phosphor coating and basing are omitted.

Formerly electric lamps were hand-made in most cases. The efficiency of production was inevitably low, and a considerable difference in quality was usually observed among the finished lamps. To avoid these drawbacks, the processes necessary for lamp production were automatized. For example, a plurality of apparatus were installed and linked by belt conveyors, and each carried out one or more manufacturing process. If necessary, the unfinished products received treatment on the conveyors. Thus, the apparatus and belt conveyors constituted a so-called automatic assembly line.

Each apparatus of such an automatic assembly line is provided with turn tables and conveyors. On the turn table there are arranged a plurality of heads to form a circle. Each head holds a bulb member which have undergone a manufacturing process by the apparatus in the preceding stage and which is to receive the process or processes assigned to the apparatus. As the turn table is driven, the bulb members held by the heads are moved. Until the turn table turns nearly 360°, each bulb member finishes undergoing the process. Then the bulb member is shifted by a belt conveyor to the next apparatus so as to receive the next process. In this way, the bulb members are subjected to various processes at different apparatus until they are made into finished products, i.e. electric lamps.

However, the above-mentioned automatic assembly line failed to suppress the difference in quality among the bulb members as well as the finished products. This is partly because the quality of the products depends on the qualities of the parts of the products, and chiefly because the quality of the products depends largely on the heads employed. Thus the products, if made of parts of good quality, may turn out to be bad ones unless all the heads are without any defect. Since each apparatus has a number of heads and the assembly line has thus countless heads, it is extremely difficult to operate all the heads in a desired manner. In other words, some heads would probably become defective ones, and the bulb members held by such defective heads would become bad ones or would have a quality difference among them. Consequently, the efficiency of production is lowered, and the qualities of the finished products cannot be equalized. Because of this drawback it has long been desired that the automatic assembly line should be improved.

An object of this invention is to provide an apparatus for manufacturing electric lamps in which defective heads, if any, are prohibited from working and do not achieve the process or processes assigned to the apparatus.

Accordingly, besides a body, a drive mechanism, an unloader and a loader, the apparatus according to this invention is provided with an inspection device for inspecting each bulb member at a predetermined position and delivering an output signal upon detecting a bad bulb member and with a controller for memorizing the code number of the head holding the bulb member which is considered to be a bad one upon receipt of the output signal from the inspection device, thereby stopping the supply of a new bulb member to the head holding the bad bulb member. In this specification, the bulb members indicate materials and parts such as bulbs, mounts, electrodes, illuminant materials (for example gases) and base caps, as well as half finished products and finished products.

Being constructed as mentioned above, the apparatus of this invention is advantageous in the following respect. Once a proper standard has been determined with respect to the quality of bulb members, the inspection device detects bad bulb members. Then the controller stops the supply of new bulb members to the heads holding these bad bulb members, thus preventing production of bad bulb members thereafter. This stopping of the supply of new bulb members does not interrupt the operation of the apparatus. As a result, the bulb members are successively supplied to the good heads only and automatically undergo the process assigned to the apparatus one after another. This makes it possible to reduce the difference among the bulb members and the finished products with respect to shape, size and other qualities.

Further, if a reject mechanism is provided to remove bad bulb members, if any, it is possible to separate bad bulb members from the good ones.

Two or more apparatus according to this invention may be linked by transfer means to constitute an assembly line for manufacturing electric lamps, and the apparatus and transfer means may be driven synchronously, continuously or intermittently. In this case, if a head holding the bulb member is found to be a bad one, the inspection device of the apparatus delivers an output signal, and the controller stops the supply of new bulb members to the heads holding the bad bulb members. Simultaneously, the output signal may supplied also to the controllers of the apparatus in the preceding stages, thereby stopping the supply of new bulb members to all the heads concerning the above described bad head. In this way, bulb members can flow smoothly along the assembly line and production of more bad bulb members can be prevented without fail. Since new bulb members are supplied to the good heads in normal manner even if the inspection device of any apparatus delivers an output signal, the operation of the assembly line need not be interrupted at all. Thus, the assembly line can keep manufacturing electric lamps, and the efficiency of production is not lowered considerably.

This invention can be more fully understood from the following detailed description when taken in conjunction with the accompanying drawings, in which.

One embodiment of this invention, for example an apparatus to carry out the exhausting process for manufacturing fluorescent lamps, will be described with reference to the accompanying drawings.

Figure 1:
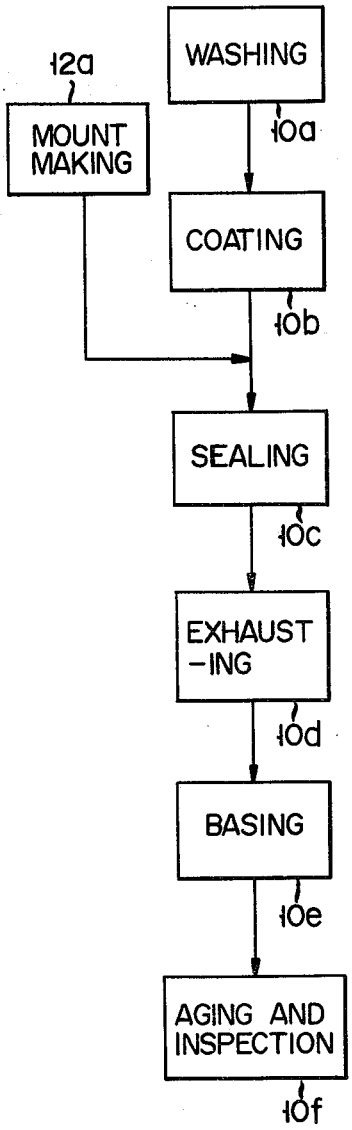
FIG. 1 is a flow chart showing the sequence of the processes necessary for manufacturing electric lamps.

Generally, glass bulb members are subjected to various processes in such sequence as shown in FIG. 1. First, they are washed in the washing process 10*a*. Then, their inner surfaces are coated with a phosphor film at the phosphor coating process 10*b*. Thereafter the mounts prepared in the mount making process 12*a* are inserted into the phosphor-coated bulb members. The bulb members now provided with a mount each are subjected to the sealing process 10*c*, in which each bulb member and mount are fused together. This done, air is exhausted from the bulb members at the exhausting process 10*d*. Further, in the exhausting process 10*d*, argon gas and mercury are introduced into the bulb members. Once the argon gas and mercury have been introduced in the bulb members, the bulb members are chipped off by a burner and thus sealed. Then, bases are fitted to the bulb members at the basing process 10*e*. The bulb members are then subjected to the aging and inspection processes and finally made into finished products. The mount making process includes some sub-processes such as flare making, stem making and filament fitting.

Figure 2:
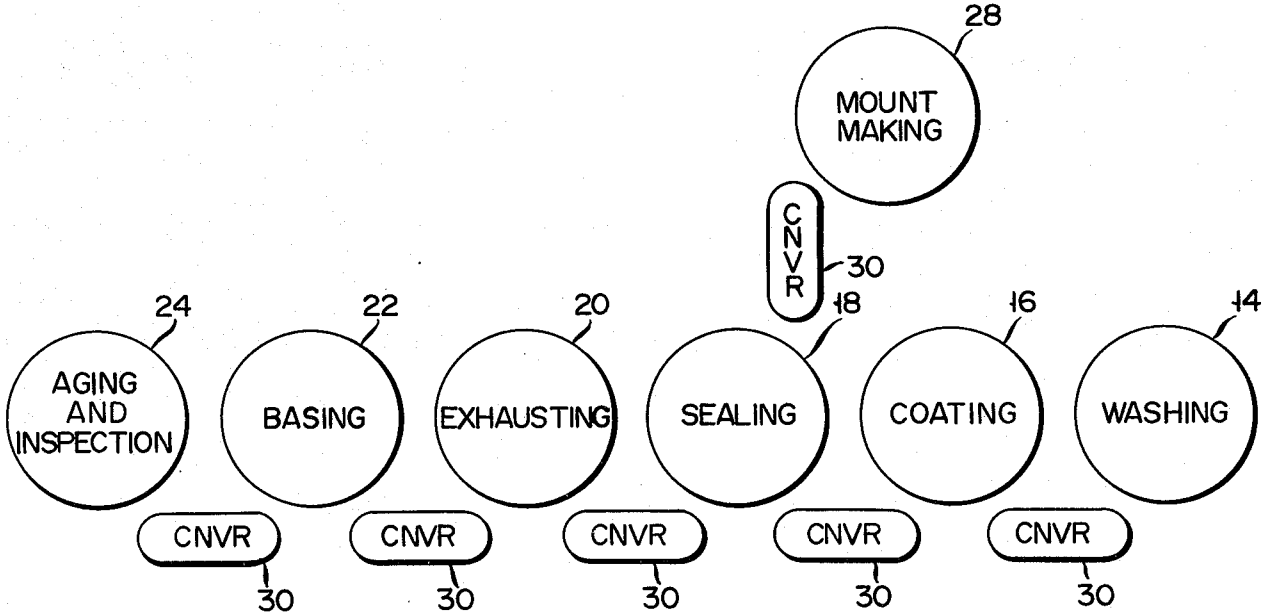
FIG. 2 is a schematic view of an assembly line including the apparatus according to this invention and a plurality of conveyors.

The assembly line illustrated in FIG. 2 comprises a plurality of apparatus to carry out various processes necessary for manufacturing electric lamps, e.g. a washing apparatus 14, a phosphor coating apparatus 16, a sealing apparatus 18, an exhausting apparatus 20, a basing apparatus 22, and an aging-inspection apparatus 24. The assembly line further comprises a mount making apparatus 28 and a plurality of transfer means, for example conveyors 30. The conveyors 30 are arranged each between any two adjacent apparatus so as to transport bulb members successively from one apparatus to another. If necessary, any one of the processes may be applied to the bulb members while the bulb members are mounted on the conveyor. At the end of each process, for instance the sealing process and the exhausting process, the bulb members are inspected one after another. If any one of the bulb members is detected to be a bad one, a detection signal is produced. Then, the head holding the bad bulb member is considered a defective one, and the bad bulb member is removed from the defective head. Thereafter, no new bulb member is supplied to the defective head.

Figure 3:
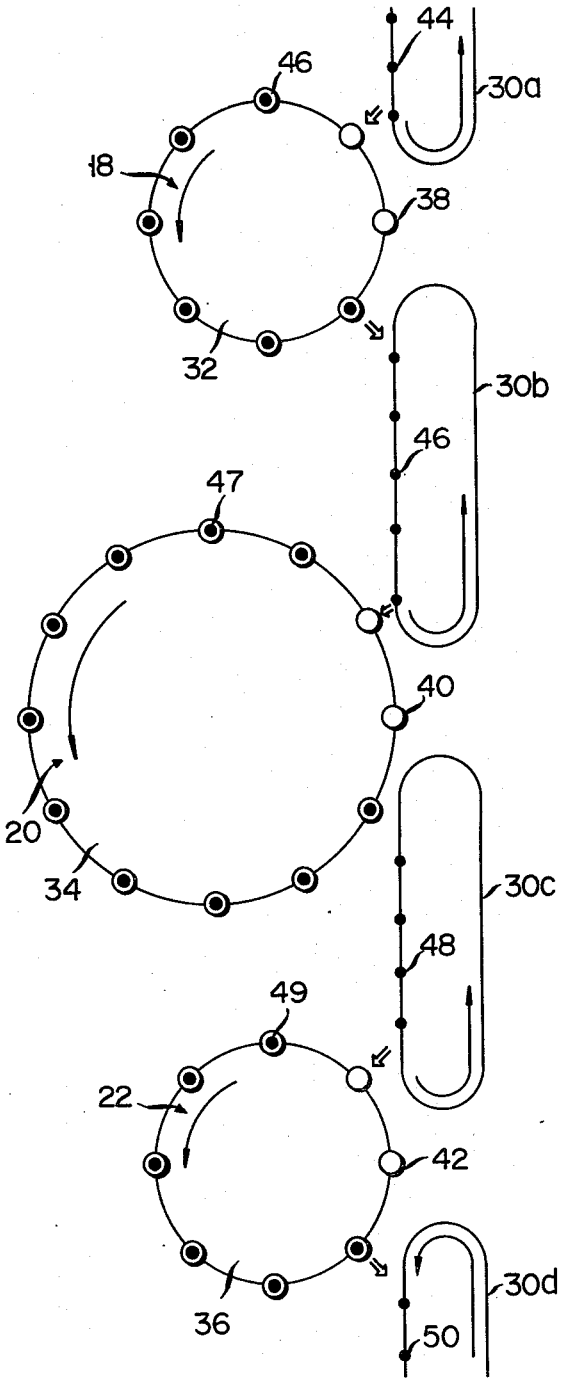
FIG. 3 shows how the heads and bulb members are moved in the apparatus of this invention which are employed so as to carry out the exhausting process and two processes, one preceding the exhausting process and the other following the exhausting process.

With reference to FIG. 3 it will now be explained how the exhausting apparatus 20 cooperates with the sealing apparatus 18 and basing apparatus 22 positioned before and after the exhausting apparatus 20, respectively and how the bulb members are moved by these apparatus 18, 20 and 22 and the conveyors 30*a* to 30*d*.

The apparatus 18, 20 and 22 are provided with turn tables 32, 34 and 36, respectively. A plurality of heads 38 are so arranged on the turn table 32 as to form a circle. Similarly, heads 40 are arranged on the turn table 34 to form a circle, and heads 42 on the turn table 36 to form a circle. The conveyors 30*a* to 30*d* are driven by appropriate drive means (not shown) in the direction of arrow synchronously, intermittently or continuously together with the turn tables 32, 34 and 36 at a speed which is determined by the speed of rotation of the turn tables 32, 34 and 36. Then, bulb members 44 are transferred by the conveyor 30*a* from the phosphor coating apparatus 16 (now shown in FIG. 3). The bulb members 44, which have been already coated with a phosphor film, are then supplied from the conveyors 30*a* to the heads 38 of the sealing apparatus 18. Further, mounts carried by a conveyor (not shown) from the mount making apparatus 28 are supplied to the heads 38 one after another. The bulb member 46 and the mount held by each head 38 are fused together while the turn table 32 turns nearly 360°.

The bulb members 46 now provided with two mounts each are removed from the heads 38, conveyed to the exhausting apparatus 20 by the conveyor 30*b*, and supplied to the heads 40. From the bulb members 47 held by the heads 40 air is exhausted. Then, mercury and inert gas are introduced into the bulb members 47. This done, the bulb members 47 are removed from the heads 40 and shifted to the conveyor 30*c*. The bulb members 48 now containing mercury and inert gas are carried by the conveyor 30*c* to the basing apparatus 22 and supplied to the heads 42 of the basing apparatus 22. While held by the heads 42, the bulb members 49 are fitted each with a pair of bases. The bulb members 49 are removed from the heads 42. The bulb members each provided with two bases, or lamps 50 are transferred by the conveyor 30*d* to the aging-inspection apparatus 24. The bases are made by an apparatus (not shown) and carried to the basing apparatus 22 by a conveyor (not shown).

Figure 4:
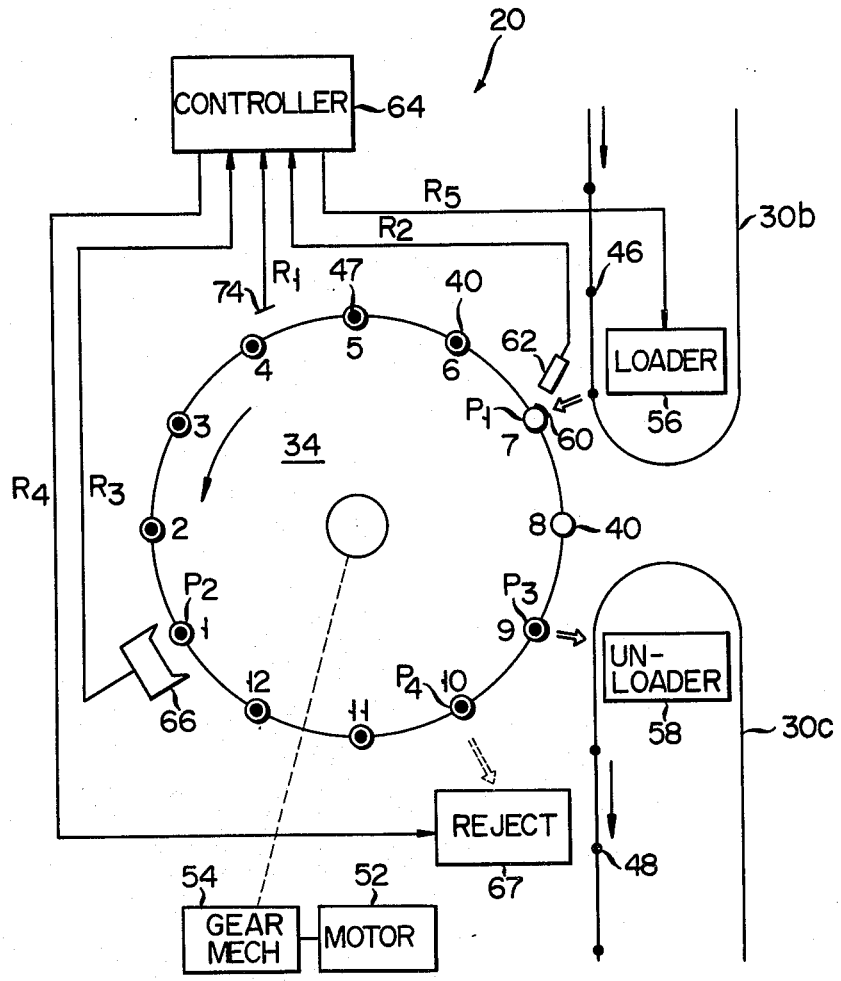
FIG. 4 shows the construction and function of the apparatus to carry out the exhausting process, which is shown in FIG. 3.

With reference to FIG. 4 the construction and function of the exhausting apparatus 20 will be described in detail. The apparatus 20 is further provided with a drive means which is constituted by a motor 52 and a gear mechanism 54. The drive means rotates the turn table 34 at a constant speed in the direction of arrow. On the turn table 34 there are arranged, for example, 12 heads 40 at equal intervals so as to form a circle. These heads 40 hold each a bulb member 46 which has been conveyed from the sealing apparatus 18 by the conveyor 30*b*. While the bulb member 47 is held by the head 40, an air-tight state is secured between the bulb member 47 and the head 40. Under this condition, air is exhausted from the bulb member 47 by a vacuum pump (not shown) connected to the head 40, and then mercury and inert gas are introduced into the bulb member 47. Of the bulb members 47 undergone the exhausting process, only good ones with their exhaust tubes sealed are shifted to the conveyor means 30*c* and are carried to the basing apparatus 22.

Further the exhausting apparatus 20 is provided with a loader 56 and an unloader 58. The loader 56 is attached to the conveyor means 30*b* and disposed near the turn table 34 so as to supply a sealed bulb member 46 to each head 40 when the head 40 comes to position $P_1$. Similarly, the unloader 58 is attached to the conveyor 30c and disposed near the turn table 34 so as to remove an exhausted bulb member 47 from each head 40 when the head 40 comes to position $P_3$. The loader 56 and the unloader 58 are driven in synchronism with the turn table 34 and the conveyors 30b and 30c.

The exhausting apparatus 20 is also provided with a sensor 62, e.g. reed switch, when is disposed near position $P_1$. The sensor 62 is turned on when a magnetic plate 60 fixed to one of the heads 40 passes by, and then produces an output signal. The output signal of the sensor 62 is transferred to a controller 61. There is provided another sensor 74 near the turn table 34. The sensor 74 supplies a signal R1 to the controller 64 when each head 40 passes by it. Further provided is a vacuum detector 66 which is disposed near position $P_2$ and which is to detect the vacuum in each bulb member 47 held by the respective head 40. The vacuum detector 66 automatically detects the vacuum in each bulb member 47 as the bulb member 47 passes by position $P_2$. If the vacuum in the bulb member 47 is found to fall outside a predetermined range of allowance, the vacuum detector 66 delivers an output signal. This output signal is supplied to the controller 64. Still further provided is a reject mechanism 67 which is disposed near position $P_4$. When the head 40 holding a bulb member 47 which is found at $P_2$ position to be an abnormal vacuum condition passes the $P_4$ position, the reject mechanism 67 removes forcibly the above mentioned bulb member 47 from the head 40.

Figure 5:
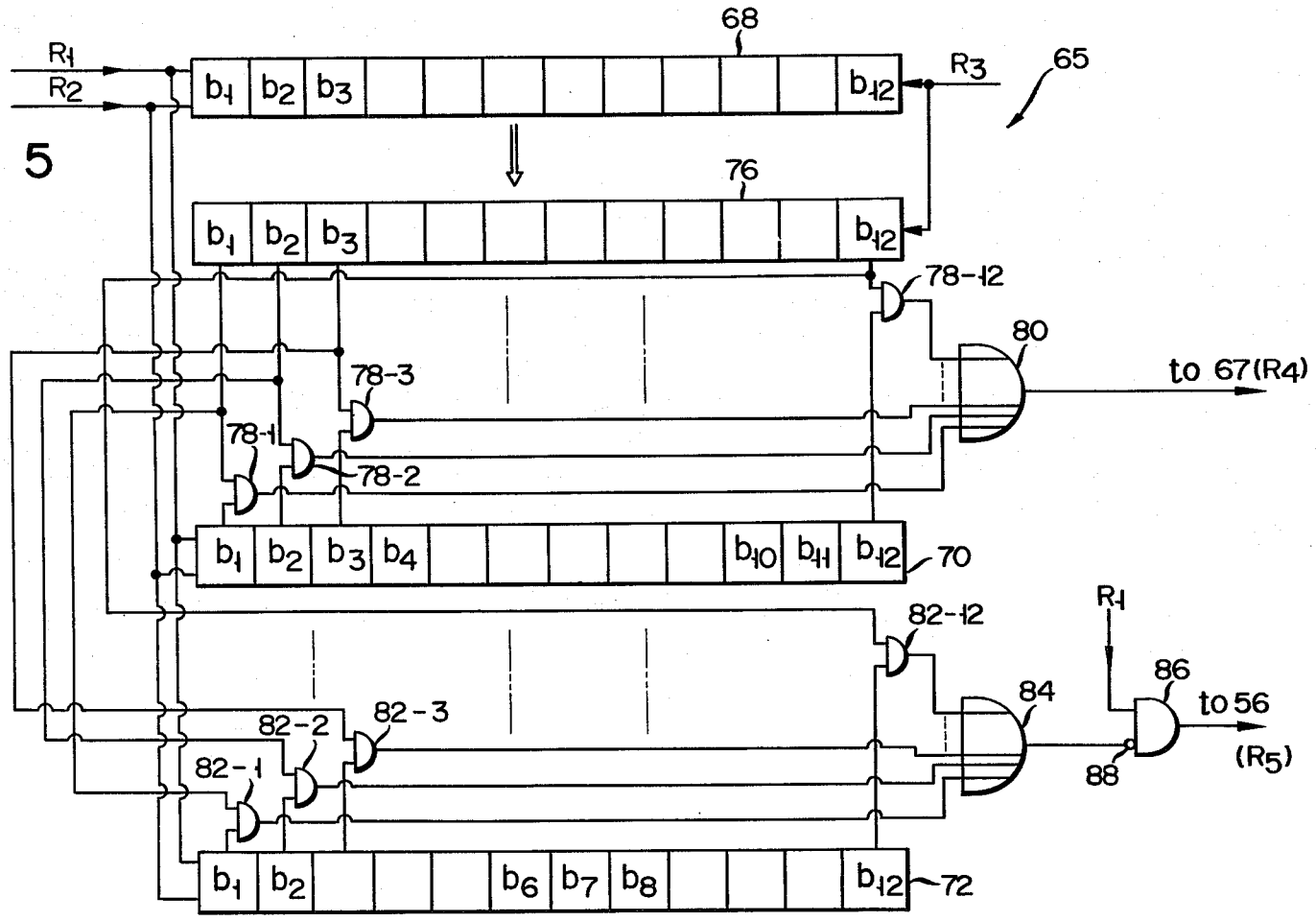
FIG. 5 is a circuit diagram showing how to detect defective heads in the apparatus shown in FIG. 4.

The controller 64 has such an electric circuit 65 as illustrated in FIG. 5. The electric circuit 65 comprises three ring counters 68, 70 and 72 each of which is constituted, for instance, by 12 bits b1 to b12. The ring counters 68, 70 and 72 advance one step every time they receive a signal R1 from the sensor 74. Upon receipt of a signal R2 from the sensor 62 the ring counters 68, 70 and 72 are cleared.

More precisely, when a signal R2 is supplied to the ring counter 68, the counter is cleared, whereby the bit signal "1" is set at the first bit b1. As signals R1 are supplied to the ring counter 68, bit signal "1" is shifted from the first bit b1 to the second bit b2, then to the third bit b3, and so forth. Upon receipt of a signal R2 the ring counter 70 is cleared whereby the bit signal "1" is set at the tenth bit b10. Thereafter the bit signal "1" is set first at the eleventh bit b11, next the twelfth bit b12, then the first bit b1, and so forth as signals R1 are supplied to the ring counter 70 one after another. The ring counter 72 is cleared also upon receipt of a signal R2, whereby the bit signal "1" is set at the seventh bit b7. Thereafter, as the ring counter 72 receives signals R1 one after another, the bit signal "1" is set first at the eighth bit b8, then the ninth bit b9, and so on.

When the output signal R3 of the vacuum detector 66 is supplied to the ring counter 68, the contents of the ring counter 68 are memorized into a register 76 which is constituted by, like the ring counter 68, twelve bits b1 to b12. Namely, if the bit signal "1" is set at the third bit b3 of the ring counter 68 when a signal R3 is fed to the ring counter 68, the bit signal "1" is set also at the third bit b3 of the register 76.

The bits b1 to b12 of the register 76 are coupled to twelve AND gate 78-1 to 78-12, respectively. Similarly, the bits b1 to b12 of the ring counter 70 are coupled to the AND gates 78-1 to 78-12, respectively. The outputs of these AND gates 78-1 to 78-12 are supplied to the reject mechanism 67 through an OR gate 80. Further, the bits b1 to b12 of the register 76 are coupled to twelve AND gates 82-1 to 82-12, respectively, and the bits b1 to b12 of the ring counter 72 to the AND gates 82-1 to 82-12, respectively. The outputs of the AND gates 82-1 to 82-12 are fed through an OR gate 84 to NOT input terminal 88 of a inhibit gate 86. To the other input terminal of the inhibit gate 86 there is supplied a signal R1. The output signal of the inhibit gate 86 is fed to the loader 56 as a drive instruction signal R5.

Now, with reference to FIGS. 4 and 5, it will be explained how the exhausting apparatus 22 operates. Let the heads 40 be assigned with serial numbers No. 1–No. 12 as shown in FIG. 4, with serial number "1" given to the head 40 which happens to face the vacuum detector 66 at position $P_2$ when the head 40 with the magnetic plate 60 passes by the sensor 62 at position $P_1$. As the head 40 with the magnetic plate 60 passes by position $P_1$, the sensor 62 delivers an output signal R2. Upon receipt of this signal R2 the ring counter 68 of the controller 64 is cleared, and the bit signal "1" is set at the first bit b1 of the ring counter 68. Thereafter, the bit signal "1" is shifted from the first bit b1 to the following bits as signal R1 are supplied to the ring counter 68 from the sensor 74.

The serial number of the head 40 at position $P_2$ is made identical with the serial number of the bit of the ring counter 68 at which the bit signal "1" is set. For example, while the bulb member 47 held by the head No. 3 is inspected by the vacuum detector 66, the bit signal "1" is set at the third bit b3 of the ring counter 68. Similarly, while the bulb member 47 held by the head No. 1 is inspected by the vacuum detector 66, the bit signal "1" is set at the tenth bit b10 in the ring counter 70 and at the seventh bit b7 in the ring counter 72. Thus, every time the head No. 1 comes to position $P_2$, the bit signal "1" is set at the first bit b1 of the ring counter 68, at the tenth bit b10 of the ring counter 70 and at the seventh bit b7 of the ring counter 72. When the head No. 2 comes to position $P_2$, the bit signal "1" is shifted to the second bit b2 in the ring counter 68, to the eleventh bit b11 in the ring counter 70 and to the eighth bit b8 in the ring counter 72. This shifting of the bit signal "1" is effected in response to a signal R1 from the sensor 74.

As long as all the twelve heads 40 operate under normal condition, the bulb members 47 held by these heads 40 are exhausted in a desired manner. Thus, the vacuum detector 66 delivers no output signal, and the contents of the ring counter 68 is not memorized into the register 76. As a result, the AND gates 78-1 to 78-12 and the AND gates 82-1 to 82-12 remain closed, and neither the OR gate 80 nor the OR gate 84 delivers an output signal. Consequently, the reject mechanism 67 remains to operate, and the loader 56 is continuously driven by signals R5 to supply the sealed bulb members 46 to the head 40, from which the exhausted bulb members 47 have been removed by the unloader 58.

In case the sealing ring provided between the bulb member 47 and the head No. 2 is defective to maintain airtight condition between them, the bulb member 47 held by the head No. 2 is exhausted but incompletely. When the defective head No. 2 comes to position $P_2$, the bit signal "1" is set at the second bit b2 in the ring counter 68, at the eleventh bit b11 in the ring counter 70 and at the eighth bit b8 in the ring counter 72. In the vacuum in the bulb member 47 held by the head No. 2 is detected by the vacuum detector 66 to fall outside the predetermined range of allowance, the vacuum detector 66 generates an output signal R3. The signal R3 is fed to both the ring counter 68 and the register 76. In response to the signal R3 the bit signal "1" of the second bit b2 in the ring counter 68 is transferred to the second bit b2 in the register 76.

As the turn table 34 further rotates, the head No. 3 comes to position $P_2$ and is inspected by the vacuum detector 66, while the defective head No. 2 is moved away from position $P_2$. Then, the head No. 4 comes to position $P_2$ and receives the vacuum inspection. When the defective head No. 2 arrives at position $P_4$ or the reject mechanism 67, the bit signal "1" is shifted to the second bit b2 in the ring counter 70. At this moment the bit signal "1" is set at the second bit b2 in both the register 76 and the ring counter 70. As a result, the AND gate 78-2 opens, and the OR gate 80 supplies a signal R4 to the reject mechanism 67. In response to the signal R4 the reject mechanism 67 removes the bad bulb member 47 from the defective head No. 2.

When the defective head No. 2 reaches position $P_1$ and the head No. 5 arrives at position $P_4$, the bit signal in the ring counter 72 is set at the second bit b2. As a result, the AND gate 82-2 opens, and the OR gate 84 supplies an output signal to the inhibit gate 86. Upon receipt of the output signal of the OR gate 84, the inhibit gate 86 is closed. Thus, despite the signal R1 supplied to the inhibit gate 86, no drive signal R5 is fed to the loader 56. In this way the supply of the sealed bulb members 46 is automatically stopped to the defective head No. 2. Thus, further sealed bulb members 46 need not be held by the defective head No. 2.

Since only good bulb members 47 whose vacuum is within the range of allowance are carried to the next apparatus, i.e. basing apparatus 22, the quality of the bulb members can be equalized. Further, since the supply of bulb members to the defective head No. 2 is automatically stopped without stopping the exhausting apparatus 20 and thus any other apparatus of the assembly line, the efficiency of production is not lowered. In addition, since no more bulb members 47 are supplied and exhausted while held by the defective head No. 2 once the poorly exhausted bulb member has been removed from the defective head No. 2, the material and power can be saved. Further, since any defective head 40 can be found merely be examining the contents of the register 76, the defective head 40 can be identified without fail and can thus be replaced by a new good one. Any head 40, if detected to be defective, may be automatically and speedily replaced by a new good one which is arranged previously. In this case, the operation of the exhausting apparatus 20 and any other apparatus of the assembly line need not be interrupted for a long time, and the efficiency of production need not be lowered so much.

Moreover, all the apparatus and all the conveyor means of an assembly line may be driven strictly in synchronism with one another. In this case, upon detection of a bad bulb member in one of the apparatus all the heads of the apparatus in the preceding stages, that have once held the bad bulb member, can be identified merely by using an electronic circuit properly designed for this purpose. Namely, the electric circuit may generate a control signal upon detection of the bad bulb member in one apparatus and the supplies the control signal to the apparatus in the preceding states, thereby stopping the supply of bulb members to all the heads that have once held the bad bulb member. If this is the case, production of bad bulb members and bad lamps can be prevented very effectively.

Moreover, a counter (not shown) may be connected between each bit of the ring counter 68 and the bit of the same serial number in the register 76, so as to count how many times the bit signal "1" has been set at the bit in a given time. It is therefore possible to memorize into the register 76 the serial numbers of the heads which have produced in one hour more bad bulb members than a predetermined number, thereby to stop the supply of new bulb members to such defective heads. In this method of detecting defective heads by a plurality of inspection processes successively applied to each of the heads, if the vacuum detector 66 sends a signal R3 each time when a bulb member held on a fixed head is inspected, it is concluded that the fixed head is defective one, and if a signal R3 is not sent each time and sent intermittently, conclusion is that each bulb member is defective which is held then on the fixed head. This method of detecting defective heads is far more reliable than the aforementioned method in which any head holding a bad bulb member is considered a defective one.

In the exhausting apparatus 20 shown in FIG. 4, the vacuum detector 66 detects the vacuum in each bulb member to find out a defective head. Each of the other apparatus is also provided with an inspection device. The inspection device is designed to, for example, examine the phosphor coating of each bulb member, the base fitted to each bulb member, the sealing condition of each bulb member, the amount of mercury and inert gas in each bulb member, the shape of each bulb member, the size of each bulb member, the crack, if any, in each bulb member, or the electric characteristic of each bulb member. The inspection device of each apparatus inspect one after another the bulb members undergone the process assigned to the apparatus, whereby bulb members considered to be bad ones are removed and not conveyed to the apparatus in the next stage and new bulb members are not supplied to the heads which have held the bad bulb members. The material and power can thus be saved. Further, since the good heads keep on holding new bulb members, the operation of each apparatus is not interrupted and the assembly line is kept operative.

Furthermore, a display panel and/or an alarm device for each head may be provided. Such a display panel or alarm devices can show, based on the contents of the register 76, which head is defective or give alarm to an operator. In this case, the operator can understand the operational condition of the individual apparatus, merely by watching the display panel or the alarm devices.

We claim:

1. An apparatus for manufacturing electric lamps having at least one of a group of means including washing means, coating means, sealing means, exhausting means, basing means and aging means, said apparatus comprising:

a plurality of heads;

means for moving said heads;

said plurality of heads cooperating with at least one of said group of means to serially effect the function of said at least one of said group of means on the bulb members held by said plurality of heads;

unloading means for successively taking the bulb members from the heads after said function is effected;

loading means for successively supplying new bulb members to the head;

inspection means for inspecting each bulb member while moving along said closed loop and delivering an output signal upon detecting a bad bulb member; and controlling means including memory means for storing the identity of the head holding a bad bulb member upon receipt of the output signal from the inspection means, and means for sending a signal to said loading means for stopping the supply of new bulb members to the head holding the bad bulb member.

2. An apparatus according to claim 1, wherein said apparatus further comprises rejecting means for removing from said moving means, at a position adjacent to said closed loop beyond said detection means, a bad bulb member as detected by said inspection means, and said controlling means further comprises means for delivering a signal to said rejecting means when the head holding the bad bulb member arrives at said position, thereby causing said rejecting means to remove the bulb member from the head.

3. An apparatus according to claim 1, wherein said driving means drives said means for moving continuously.

4. An apparatus according to claim 1, wherein said driving means drives said means for moving intermittently, thereby moving the heads step by step.

5. An apparatus according to claim 1, wherein said means for moving comprises a turn table on which a plurality of heads are so arranged at equal intervals as to form a ring concentric with the turn table.

6. An apparatus according to claim 1 wherein: said apparatus further comprises:

a plurality of moving means, loading means, unloading means and controlling means, each of said plurality of moving means cooperating with a plurality of heads and one of said plurality of loading means, unloading means and controlling means, and one of said group of means, and conveying means for transferring said bulb members from the unloading means cooperating with one of said moving means to the loading means cooperating with another of said moving means; and said controlling means cooperating with said another moving means further comprises means for sending a signal to stop the supply of new bulb members so that head of said one moving means which has supplied the bad bulb member to the head having the stored identity.

7. An apparatus according to claim 6, wherein said apparatus further comprises rejecting means for removing from said moving means, at a position adjacent to said closed loop beyond said detection means, a bad bulb member as detected by said inspection means, and said controlling means further comprises means for delivering a signal to said rejecting means when the head holding the bad bulb member arrives at said position, thereby causing said rejecting means to remove the bad bulb member from the head.

8. An apparatus according to claim 1 wherein said controlling means comprises:

first sensing means for delivering a first signal every time one head passes by said first sensing means;

first ring counting means having a plurality of storage locations, each of said plurality of storage locations associated with one of said heads, respectively, for storing a first bit signal at the storage location associated with the head passing by said inspection means upon receipt of said first signal;

second ring counting means having a plurality of storage locations, each of said plurality of storage locations associated with one of said heads, respectively, for storing a second bit signal at the storage location associated with the head receiving a new bulb member from said loading means upon receipt of said first signal;

register means having a plurality of storage locations, each of said plurality of storage locations associated with one each of the plurality of storage locations of said first and second ring counting means, respectively, for storing a third bit signal, upon receipt of an output signal from said inspection means, at the storage location in said register means associated with the storage location in said first ring counting means which is set with said first bit signal; and electric circuit means for delivering a second signal to actuate said loading means only when the second ring counting means storage location associated with the storage location in said register means which is set with said third bit signal is set with said second bit signal.

9. An apparatus according to claim 8 wherein: said apparatus further comprises rejecting means for removing from said moving means, at a position adjacent to said closed loop beyond said detection means, a bad bulb member as detected by said inspection means; and said controlling means further comprises:

third ring counting means having a plurality of storage locations, each of said plurality of storage locations associated with one of said heads and one of said plurality of register means storage locations, respectively, for storing a fourth bit signal at the storage location is said third ring counting means associated with the head passing by said rejecting means upon receipt of said first signal, means for delivering a third signal for actuating said rejecting means when the third ring counting means storage location associated with the storage location in said register means which is set with said second bit signal is set with said fourth bit signal and thus when a bad head holding a bulb member arrives at said rejecting means.

* * * * *